US011460019B2

(12) United States Patent
Watanabe

(10) Patent No.: US 11,460,019 B2
(45) Date of Patent: Oct. 4, 2022

(54) COMPRESSOR MODULE

(71) Applicant: MITSUBISHI HEAVY INDUSTRIES COMPRESSOR CORPORATION, Tokyo (JP)

(72) Inventor: Takuya Watanabe, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 273 days.

(21) Appl. No.: 16/349,867

(22) PCT Filed: Feb. 17, 2017

(86) PCT No.: PCT/JP2017/005918
§ 371 (c)(1),
(2) Date: May 14, 2019

(87) PCT Pub. No.: WO2018/150541
PCT Pub. Date: Aug. 23, 2018

(65) Prior Publication Data

US 2019/0331106 A1 Oct. 31, 2019

(51) Int. Cl.
*F04B 41/00* (2006.01)
*F04D 25/02* (2006.01)
*F04B 23/02* (2006.01)

(52) U.S. Cl.
CPC ..... *F04B 41/00* (2013.01); *F04B 23/025* (2013.01); *F04D 25/02* (2013.01); *F04C 2240/809* (2013.01)

(58) Field of Classification Search
CPC .. Y10T 137/86035; F04B 41/00; F04B 41/02; F04B 23/025; F04B 23/026;
(Continued)

(56) References Cited

U.S. PATENT DOCUMENTS 1,553,149 A * 9/1925 Doran ..... F16C 33/10 184/6.21
2,162,639 A 6/1939 Pontis et al.
(Continued)

FOREIGN PATENT DOCUMENTS

CN 106246555 A 12/2016
DE 20110360 U1 10/2002
(Continued)

OTHER PUBLICATIONS

International Search Report issued in corresponding International Patent Application No. PCT/JP2017/005918, dated Apr. 11, 2017 (4 pages).
(Continued)

*Primary Examiner* — Philip E Stimpert
*Assistant Examiner* — Dnyanesh G Kasture
(74) *Attorney, Agent, or Firm* — Osha Bergman Watanabe & Burton LLP

(57) ABSTRACT

A compressor module includes: a rotational driving machine having an output shaft which is rotationally driven around an axis; a compressor which is disposed so as to be adjacent to the rotational driving machine in an axial direction in which the axis extends; a base plate which supports the rotational driving machine and the compressor from below in a vertical direction; and a storage tank which is configured to store a lubricating oil used in the rotational driving machine and the compressor. The storage tank has a tubular tank main body that is provided on an outer side of the base plate in a width direction and extends in a direction including the axial direction.

3 Claims, 5 Drawing Sheets

(58) Field of Classification Search
CPC ..... F04B 53/18; F04B 39/0284; F04C 2240/809; F04D 13/16; F04D 25/02; F16C 2360/44; F16C 33/6685; F16C 33/1025; F16C 33/1045–33/1055; F16C 33/6659–33/6677; F16C 17/26; F16C 19/54–19/548; F16C 2360/43; F16C 2362/52; F16C 2360/24; F16N 19/00; F16N 7/00; F16N 31/00
USPC ..... 184/6.16; 62/469; 384/316; 417/372, 417/413.12, 413.13
See application file for complete search history.

(56) References Cited

U.S. PATENT DOCUMENTS

| | | | | |
|---|---|---|---|---|
| 2,460,814 | A | 2/1949 | Duerr, Jr. | |
| 2,609,065 | A * | 9/1952 | Douglas | F01D 25/18 184/6.11 |
| 2,739,758 | A | 3/1956 | Lamberton | |
| 3,176,913 | A * | 4/1965 | Sorg | F25B 43/02 418/85 |
| 3,547,164 | A | 12/1970 | Bloom | |
| 5,220,978 | A * | 6/1993 | McMaster | F16N 39/02 165/104.21 |
| 5,277,564 | A | 1/1994 | Tamura et al. | |
| 5,382,141 | A * | 1/1995 | Stinessen | F04D 25/0686 417/423.8 |
| 5,626,468 | A * | 5/1997 | Muir | F04B 35/002 248/639 |
| 8,496,089 | B2 | 7/2013 | Czechowski et al. | |
| 2006/0245937 | A1 | 11/2006 | Goodwin et al. | |
| 2014/0144140 | A1 * | 5/2014 | Thompson | F01D 25/24 60/734 |

FOREIGN PATENT DOCUMENTS

| | | | |
|---|---|---|---|
| GB | 925490 | A | 5/1963 |
| JP | S48003130 | Y1 | 1/1973 |
| JP | S4920106 | U | 2/1974 |
| JP | S53-082807 | U | 7/1978 |
| JP | S54-148967 | A | 11/1979 |
| JP | S58152577 | U | 10/1983 |
| JP | S61-151097 | U | 9/1986 |
| JP | 3046880 | U | 3/1998 |
| JP | 2009-174356 | A | 8/2009 |
| JP | 2013-060882 | A | 4/2013 |

OTHER PUBLICATIONS

Written Opinion issued in corresponding International Patent Application No. PCT/JP2017/005918, dated Apr. 11, 2017 (12 pages).

* cited by examiner

COMPRESSOR MODULE

TECHNICAL FIELD

The present invention relates to a compressor module.

BACKGROUND ART

A compressor module in which a compressor which compresses gases, such as air or gas, and a rotational driving machine, such as a motor or a turbine which drives the compressor, are installed on a base plate, is used. In the compressor module, a storage tank which collects lubricating oil used in the compressor or the rotational driving machine is also integrally provided. Therefore, in such a compressor module, there is a merit that the entire compressor module can be made compact. Further, in such a compressor module, by sending the storage tank and the compressor and the rotational driving machine to the site in a state of being integrated with each other, there is a merit that it is possible to reduce the work of connecting adjustment or the like of pipings on site and it is possible to simplify the installation work.

For example, Patent Document 1 describes a turbo compressor in which a motor and a plurality of compressors are integrated. In the turbo compressor, a lubricating oil tank which is a storage tank is provided below a gear case that connects the motor and the compressor to each other.

Incidentally, a drain piping for collecting the lubricating oil used in the compressor and the rotational driving machine is connected to the storage tank. In order to allow the lubricating oil to flow from the compressor and the rotational driving machine to the storage tank, it is necessary to dispose the drain piping with a gradient determined according to a standard so as to go down toward the storage tank.

CITATION LIST

Patent Literature

[Patent Document 1] Japanese Unexamined Patent Application, First Publication No. 2013-60882

SUMMARY OF INVENTION

Technical Problem

However, in the structure described in Patent Document 1, although it is possible to save the space of the compressor module, it is necessary to provide a storage tank having a function as a base plate for stably supporting the gear case. As a result, high strength is required for the storage tank. In a case where the storage tank is given strength, the weight of the storage tank increases. Therefore, there is a demand for saving the space of the compressor module while limiting an increase in weight of the storage tank.

The present invention provides a compressor module which is capable of saving space.

Solution to Problem

According to a first aspect of the present invention, there is provided a compressor module including: a rotational driving machine having an output shaft which is rotationally driven around an axis; a compressor which is arranged side by side in an axial direction in which the axis extends with respect to the rotational driving machine, and to which rotation of the output shaft is transmitted; a base plate which is configured to support the rotational driving machine and the compressor from below in a vertical direction, and is larger than the rotational driving machine and the compressor when viewed from above in the vertical direction; and a storage tank which is configured to store a lubricating oil used in the rotational driving machine and the compressor, in which the storage tank has a tubular tank main body that is provided on an outer side of the base plate in a width direction intersecting with the axial direction and extends in a direction including the axial direction.

With the configuration, it becomes unnecessary to install the tank main body in the base plate while using the base plate and the tank main body as separate members, and it is possible to reduce the size of the base plate. Further, by making the tank main body in a tubular shape that extends in the direction including the axial direction, it is possible to ensure the capacity of the storage tank while limiting an overhanging dimension of the storage tank to the outer side of the base plate in the width direction.

In the compressor module according to a second aspect of the present invention, in the first aspect, the tank main body may extend from a position overlapping at least a part of the rotational driving machine to a position overlapping at least a part of the compressor when viewed in a direction orthogonal to the axial direction.

According to the configuration, the tank main body is disposed in a direction orthogonal to the axial direction of the rotational driving machine and the compressor. Therefore, by only extending the drain piping for returning the lubricating oil discharged from the rotational driving machine or the compressor to the storage tank in the direction orthogonal to the axial direction, the rotational driving machine and the compressor are connected to the tank main body. Accordingly, it is possible to shorten the length of the drain piping necessary to make the lubricating oil flow.

In the compressor module according to a third aspect of the present invention, in the first or second aspect, a drain piping for returning the lubricating oil from the rotational driving machine or the compressor to the tank main body, may be provided, and the drain piping may be connected to a side surface of the tank main body.

In the compressor module according to a fourth aspect of the present invention, in the third aspect, the drain piping may be inclined so as to extend downward in the vertical direction and extend in the width direction toward the tank main body.

According to the configuration, since it is possible to shorten the drain piping, the height for ensuring a necessary gradient when installing the drain piping is low. Therefore, it is possible to suppress the installation height of the rotational driving machine or the compressor. Accordingly, the moment received from the rotational driving machine or the compressor is reduced, and a dynamic load on the base plate is reduced. Therefore, it is possible to configure the base plate at a low cost such that the rigidity required for the base plate is lowered and the number or the height of the beams is reduced.

In the compressor module according to a fifth aspect of the present invention, in any one of the first to the fourth aspects, the base plate may include a first beam portion which is provided with a space in the axial direction and extends in the width direction, and a second beam portion which is provided with a space in the width direction and extends in the axial direction, and the tank main body may be disposed on the outer side of the base plate and fixed to the side surface of the second beam portion, when viewed from above in the vertical direction.

In the compressor module according to a sixth aspect of the present invention, in any one of the first to the fifth aspects, a lubricating oil supply device that is configured to supply the lubricating oil to the rotational driving machine and the compressor may be provided on the tank main body.

According to the configuration, it becomes unnecessary to ensure the space for installing the lubricating oil supply device on the base plate. Accordingly, it is possible to reduce the size of the base plate.

Advantageous Effects of Invention

According to the present invention, space saving can be achieved.

DESCRIPTION OF EMBODIMENTS

Hereinafter, a compressor module 1 of the present invention will be described with reference to the drawings.

Figure 1:
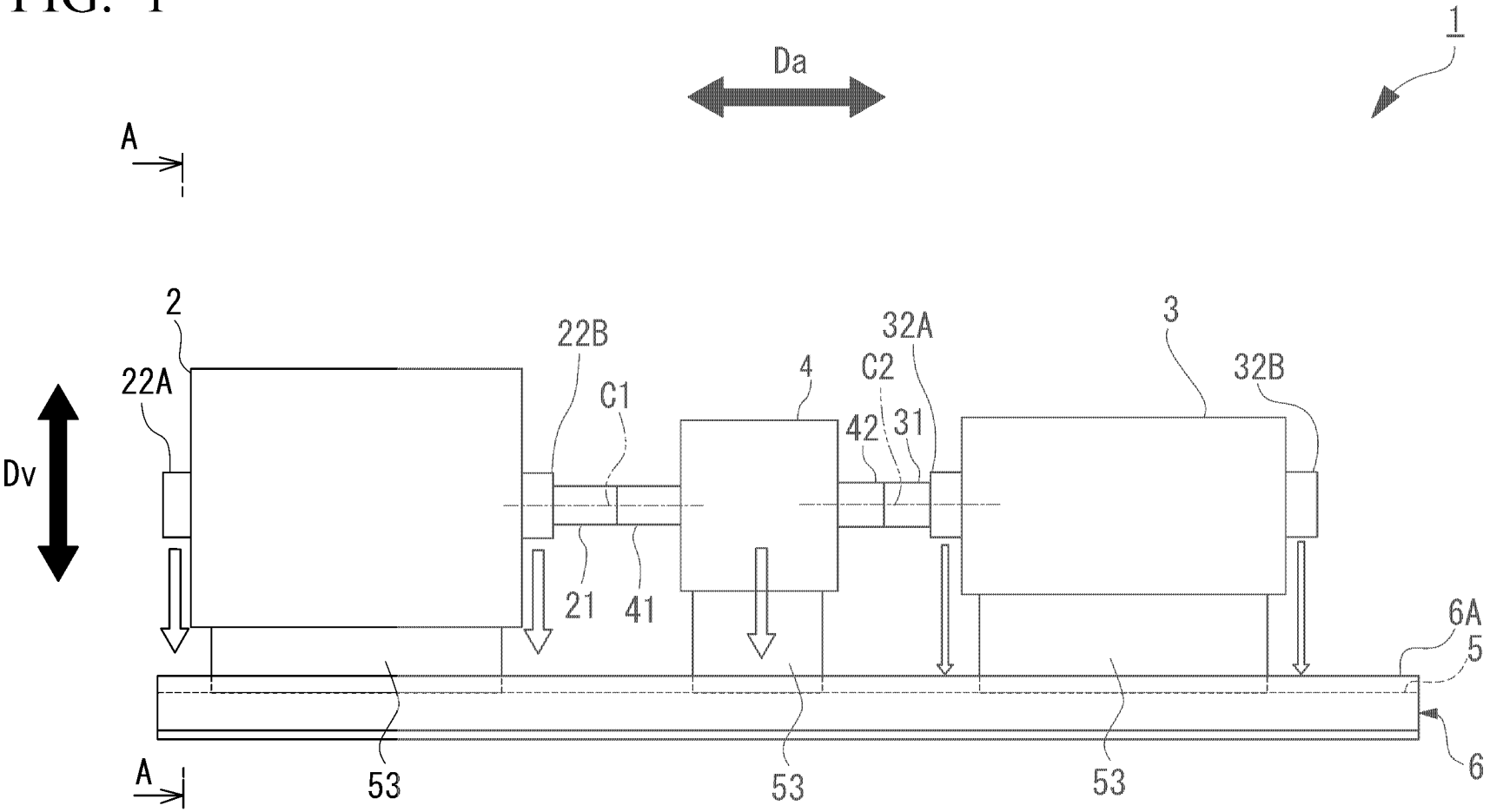
FIG. 1 is a side view showing an outline of a compressor module according to an embodiment of the present invention from a width direction.
Figure 2:
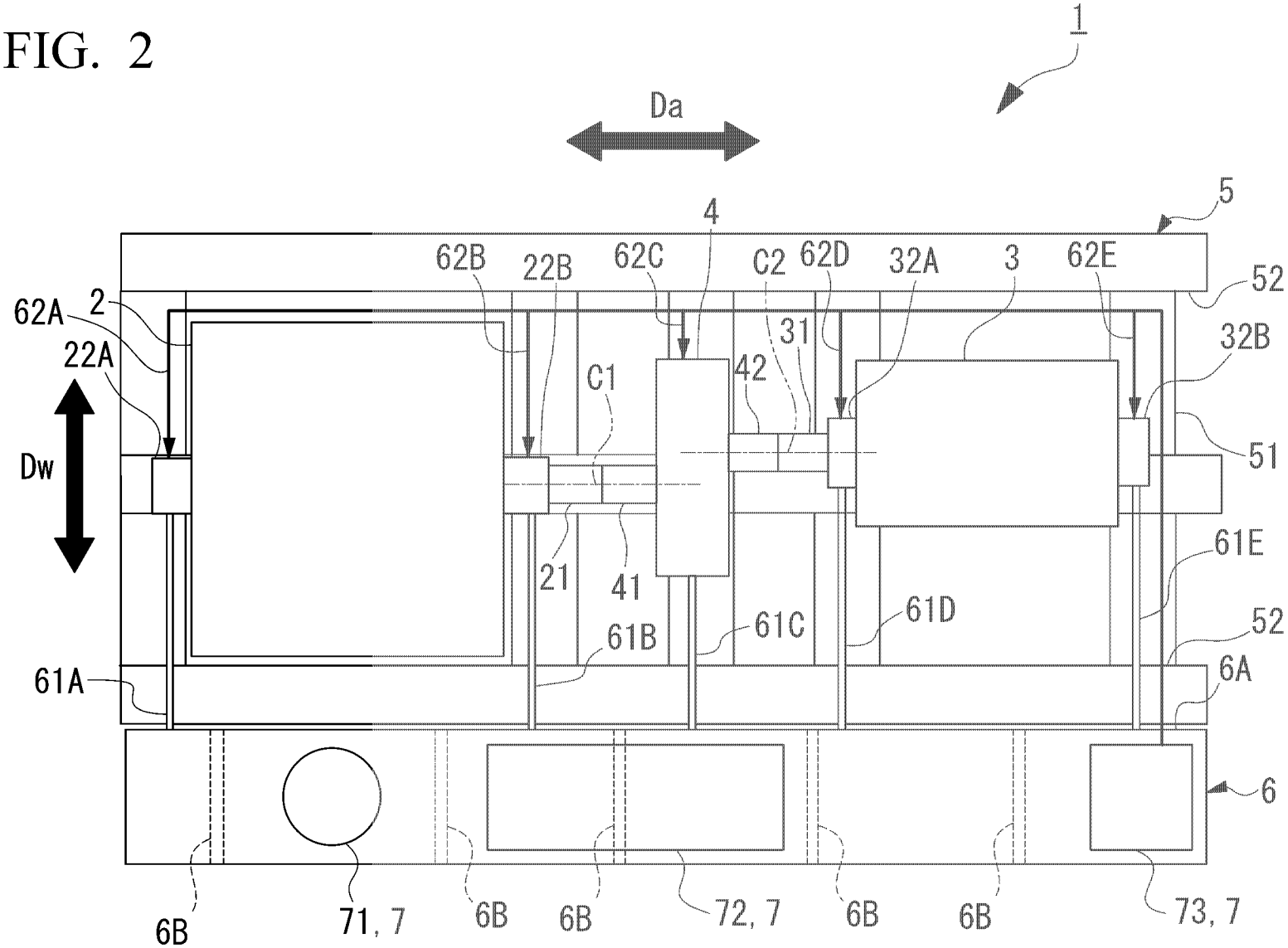
FIG. 2 is a plan view showing an outline of the compressor module according to the embodiment of the present invention from an axial vertical direction.

As shown in FIGS. 1 and 2, the compressor module 1 includes a rotational driving machine 2, a compressor 3, a transmission 4, a base plate 5, a storage tank 6, a lubricating oil supply portion (lubricating oil supply device) 7, and a fixing portion 8.

The rotational driving machine 2 is connected to the compressor 3 via the transmission 4. The rotational driving machine 2 drives the compressor 3. The rotational driving machine 2 has an output shaft 21 which is rotationally driven. The rotational driving machine 2 has a driving machine first bearing 22A and a driving machine second bearing 22B that rotatably support the output shaft 21 around a first axis (axis) C1. The driving machine second bearing 22B is provided on the output shaft 21 side in an axial direction Da with respect to the driving machine first bearing 22A. The rotational driving machine 2 of the present embodiment is an electric motor. The rotational driving machine 2 always drives the output shaft 21 at a constant speed to rotate around the first axis C1. The output shaft 21 has a columnar shape with the first axis C1 as the center.

In addition, in the present embodiment, a direction orthogonal to a vertical direction Dv and a direction in which the first axis C1 extends are referred to as the axial direction Da. In other words, the vertical direction Dv is one direction intersecting with the axial direction Da. In addition, a direction orthogonal to the axial direction Da and the vertical direction Dv is referred to as a width direction Dw. In other words, the width direction Dw is one of a direction intersecting with the axial direction Da, and is a direction different from the vertical direction Dv.

The compressor 3 is arranged side by side at intervals in the axial direction Da with respect to the rotational driving machine 2. In the compressor 3, the rotation of the output shaft 21 is transmitted via the transmission 4. The compressor 3 of the present embodiment is, for example, a multistage centrifugal compressor. The compressor 3 has a rotor 31 connected to the transmission 4. The rotor 31 is rotated around a second axis (axis) C2. The rotor 31 has a columnar shape with the second axis C2 as the center. The compressor 3 has a compressor first bearing 32A and a compressor second bearing 32B that rotatably support the rotor 31 around the second axis C2. The compressor first bearing 32A is provided on the rotor 31 side in the axial direction Da with respect to the compressor first bearing 32A. In addition, in the present embodiment, the second axis C2 is parallel to the first axis C1 and extends at a position shifted in the width direction Dw with respect to the first axis C1.

The compressor 3 is driven by the rotation of the output shaft 21 being transmitted to the rotor 31 via the transmission 4. The compressor 3 compresses a taken-in working fluid by the rotation of the rotor 31, and thus, a compressed fluid is generated. In addition, here, the application of the compressed fluid generated by the compressor 3 is not limited at all.

The transmission 4 transmits the rotation of the rotational driving machine 2 to the compressor 3. The transmission 4 of the present embodiment is an accelerating machine that accelerates the rotation of the rotational driving machine 2 by a plurality of gears. The transmission 4 is disposed to be interposed between the rotational driving machine 2 and the compressor 3 in the axial direction Da. The transmission 4 of the present embodiment has a transmission input shaft 41 connected to the output shaft 21 and a transmission output shaft 42 connected to the rotor 31.

The transmission input shaft 41 is rotated around the first axis C1. The transmission input shaft 41 has a columnar shape with the first axis C1 as the center.

The transmission output shaft 42 is rotated around the second axis C2. The transmission output shaft 42 has a columnar shape with the second axis C2 as the center. In other words, the transmission output shaft 42 extends in parallel to the transmission input shaft 41 at a position shifted in the width direction Dw from the transmission input shaft 41. The transmission output shaft 42 transmits the accelerated rotation input from the transmission input shaft 41 connected to the output shaft 21 to the connected rotor 31.

The base plate 5 supports the rotational driving machine 2, the compressor 3, and the transmission 4 from below in the vertical direction Dv. In other words, the rotational driving machine 2, the compressor 3, and the transmission 4 are installed on the base plate 5. As shown in FIG. 2, the base plate 5 of the embodiment is configured with a plurality of vertical beam portions (first beam portions) 51, a plurality of transverse beam portions (second beam portions) 52, and a support portion 53. The base plate 5 has a lattice-shaped frame as the plurality of vertical beam portions 51 and the plurality of transverse beam portions 52 are combined with each other and are fixed to each other by welding or the like. The base plate 5 is formed to have a size that overlaps the entire region of the rotational driving machine 2, the compressor 3, and the transmission 4 when viewed from above in the vertical direction Dv.

The plurality of vertical beam portions 51 are provided so as to be spaced apart in the axial direction Da. The vertical beam portion 51 extends in the width direction Dw. The vertical beam portion 51 is welded and fixed to the plurality of transverse beam portions 52. The vertical beam portion 51 is formed of a material with high rigidity that can be supported without deformation even when heavy loads, such as the rotational driving machine 2, the compressor 3, and the transmission 4, are placed. The vertical beam portion 51 of the present embodiment is formed of carbon steel.

Each vertical beam portion 51 is a steel material of a cross-section H type. The vertical beam portion 51 is formed by integrally forming a flat vertical upper flange 51*a*, a flat vertical lower flange 51*b*, and a flat vertical web 51*c*.

The vertical upper flange 51*a* and the vertical lower flange 51*b* are in a shape of a rectangular flat plate having the same size. The vertical lower flange 51*b* is provided with a space below the vertical upper flange 51*a* in the vertical direction Dv. The vertical lower flange 51*b* of the present embodiment is installed on a foundation B. The vertical web 51*c* extends in the vertical direction Dv. The vertical web 51*c* connects the vertical upper flange 51*a* and the vertical lower flange 51*b*. The vertical web 51*c* is connected to a center position of the vertical upper flange 51*a* in the width direction Dw. The vertical web 51*c* is connected to a center position of the vertical lower flange 51*b* in the width direction Dw. The vertical upper flange 51*a*, the vertical lower flange 51*b*, and the vertical web 51*c* are welded to each other to be integrated with each other.

The plurality of transverse beam portions 52 are provided so as to be spaced apart in the width direction Dw. The transverse beam portions 52 form the end portions on both sides of the base plate 5, respectively. Each transverse beam portion 52 extends in the axial direction Da so as to have the same length as the entire length of the base plate 5 in the axial direction Da. The transverse beam portion 52 of the present embodiment is formed of carbon steel. The plurality of transverse beam portions 52 are fixed to the plurality of vertical beam portions 51 by welding or the like.

Figure 4:
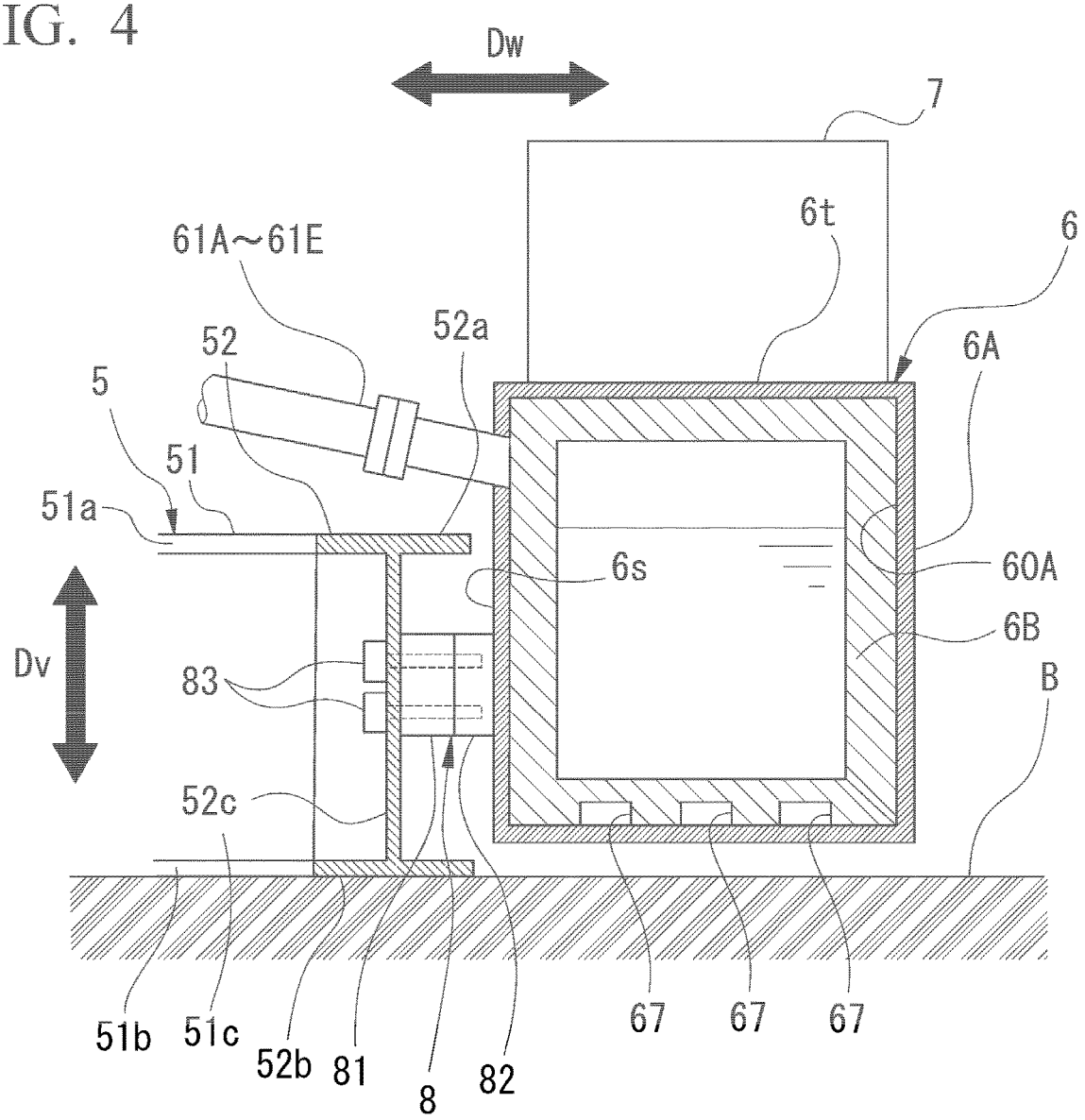
FIG. 4 is a partially enlarged sectional view of FIG. 3 showing a fixing portion of the storage tank of the compressor module according to the embodiment of the present invention from the axial direction.

As shown in FIG. 4, each transverse beam portion 52 is a steel material of a cross-section H type. Each transverse beam portion 52 is formed by integrating a transverse upper flange 52*a*, a transverse lower flange 52*b*, and a transverse web (side surface) 52*c* with each other.

The transverse upper flange 52*a* is provided such that the position of the upper surface oriented upward in the vertical direction Dv has the same height as the upper surface of the vertical upper flange 51*a*. The transverse lower flange 52*b* is provided with a space below the transverse upper flange 52*a* in the vertical direction Dv. The transverse lower flange 52*b* of the embodiment is installed on the foundation B. The transverse web 52*c* extends in the vertical direction Dv. The transverse web 52*c* connects the transverse upper flange 52*a* and the transverse lower flange 52*b* to each other. The transverse web 52*c* is connected to a center position of the transverse upper flange 52*a* in the width direction Dw. The transverse web 52*c* is connected to a center position of the transverse lower flange 52*b* in the width direction Dw. The transverse upper flange 52*a*, the transverse lower flange 52*b*, and the transverse web 52*c* are welded to each other to be integrated with each other.

The support portion 53 is fixed above the vertical beam portion 51 and the plurality of transverse beam portions 52 assembled in a lattice shape in the vertical direction Dv. The support portion 53 supports the rotational driving machine 2, the compressor 3, and the transmission 4 from below in the vertical direction Dv. The support portion 53 is installed to adjust the height of the rotational driving machine 2, the compressor 3, and the transmission 4 in the vertical direction Dv to any height.

As shown in FIG. 1, the storage tank 6 stores the lubricating oil used in the rotational driving machine 2, the transmission 4, and the compressor 3. The lubricating oil of the present embodiment is used in a driving machine first bearing 22A, a driving machine second bearing 22B, a gear and a bearing (not shown) on the inside of the transmission 4, a compressor first bearing 32A of the compressor, and the compressor second bearing 32B. The storage tank 6 is disposed below the driving machine first bearing 22A, the driving machine second bearing 22B, the gear and the bearing (not shown) on the inside of the transmission 4, the compressor first bearing 32A of the compressor, and the compressor second bearing 32B in the vertical direction Dv. More specifically, the storage tank 6 is disposed such that the position of a liquid surface of the lubricating oil stored on the inside is below the driving machine first bearing 22A, the driving machine second bearing 22B, the gear and the bearing (not shown) on the inside of the transmission 4, the compressor first bearing 32A of the compressor, and the compressor second bearing 32B in the vertical direction Dv. The storage tank 6 of the present embodiment has a tank main body 6A and a plurality of reinforcing portions 6B.

The compressor module 1 of the present embodiment includes a plurality of drain pipings 61A to 61E for returning the lubricating oil from the rotational driving machine 2, the compressor 3, and the transmission 4 to the tank main body 6A. The drain pipings 61A to 61E are connected to the side surface of the tank main body 6A. Therefore, as shown in FIG. 2, the storage tank 6 of the present embodiment is connected to the drain pipings 61A to 61E through which the lubricating oil flows by its own weight from the rotational driving machine 2, the compressor 3, and the transmission 4. The storage tank 6 is connected to the driving machine first bearing 22A by the drain piping 61A. The storage tank 6 is connected to the driving machine second bearing 22B by the drain piping 61B. The storage tank 6 is connected to the gear and the bearing on the inside of the transmission 4 by the drain piping 61C. The storage tank 6 is connected to the compressor first bearing 32A by the drain piping 61D. The storage tank 6 is connected to the compressor second bearing 32B by the drain piping 61E. The drain pipings 61A to 61E of the present embodiment extend obliquely downward in the vertical direction Dv as extending in the width direction Dw toward the tank main body 6A. For example, the drain pipings 61A to 61E are installed with a gradient of at least approximately 1/25.

As shown in FIGS. 1 and 2, the tank main body 6A has a tubular shape which extends in a direction including the axial direction Da. The tank main body 6A of the present embodiment has a bottomed angular tubular shape that extends in the axial direction Da. The tank main body 6A is fixed to the base plate 5 by the fixing portion 8 to be described later. The tank main body 6A is formed with a size that can ensure a flowing time during which air bubbles in the lubricating oil are sufficiently deaerated while the lubricating oil circulates on the inside thereof. Further, the tank main body 6A extends in the axial direction Da from the position of which at least a part overlaps the position of the rotational driving machine 2 in the axial direction Da to the position of which at least a part overlaps the position of the compressor 3 in the axial direction Da, when viewed from a direction orthogonal to the axial direction Da. Therefore, when viewed from the width direction Dw or the vertical direction Dv, the tank main body 6A extends such that the position in the axial direction Da overlaps the position of the rotational driving machine and the compressor 3 in the axial direction Da. The tank main body 6A of the present embodiment extends such that a length in the axial direction Da is longer than that of the region where all of the rotational driving machine 2, the transmission 4, and the compressor 3 are disposed, when viewed from the outer side in the width direction Dw. The tank main body 6A of the present embodiment has a length in the axial direction Da substantially the same as the length of the base plate 5. The tank main body 6A is provided on the outer side of the base plate 5 in the width direction Dw. The tank main body 6A is disposed on the outer side of the vertical beam portion 51 and the transverse beam portion 52 in the width direction Dw so as not to overlap the transverse beam portion 52 when viewed from the vertical direction Dv. The tank main body 6A of the present embodiment is formed of a material having high corrosion resistance, such as austenitic stainless steel, against the lubricating oil, air, and moisture.

Figure 3:
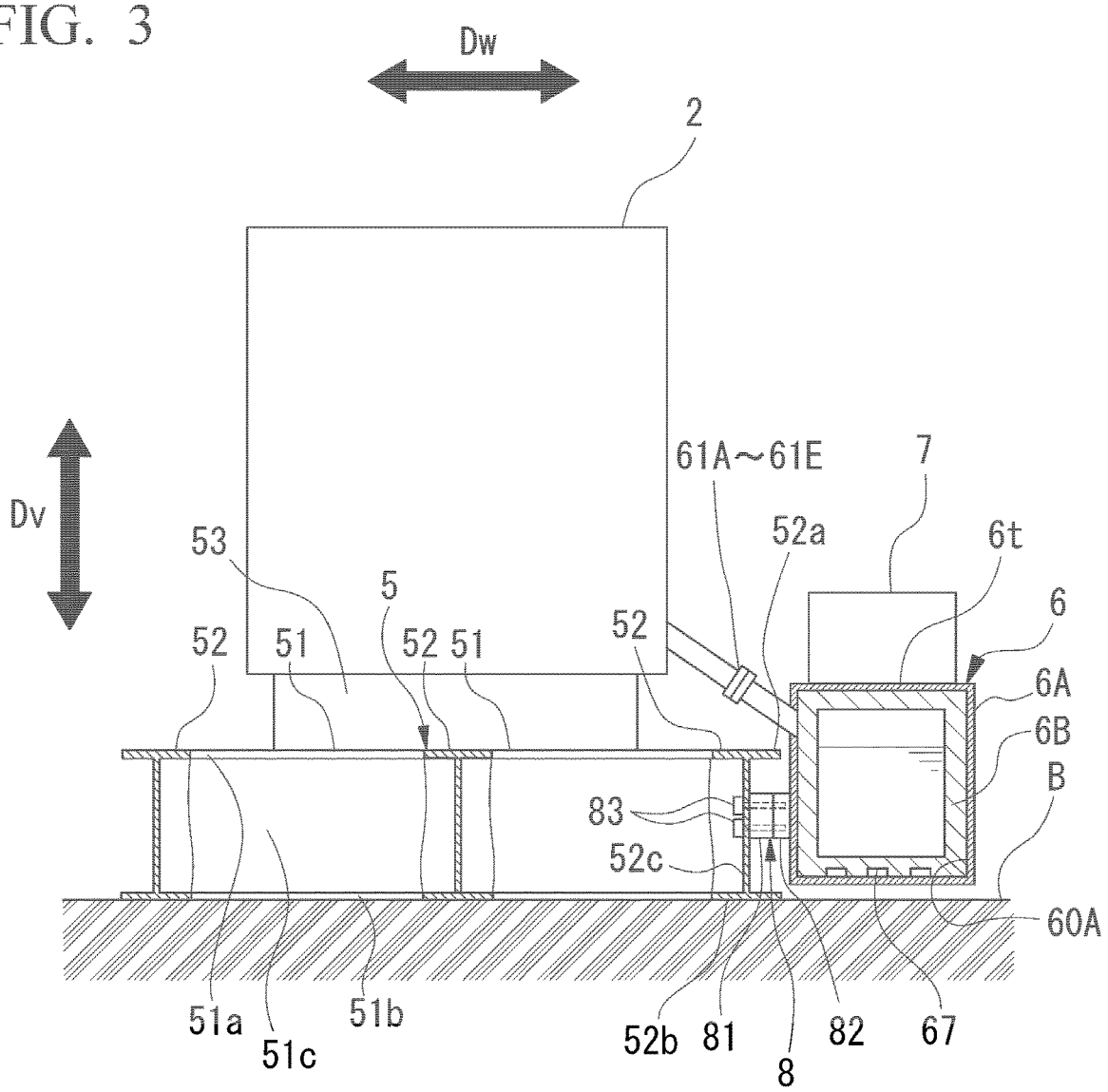
FIG. 3 is a sectional view taken along line A-A of FIG. 1 showing an outline of the compressor module according to the embodiment of the present invention from an axial direction.

As shown in FIGS. 2 to 4, the reinforcing portion 6B of the present embodiment is disposed on the inside of the tank main body 6A. The reinforcing portion 6B is fixed to an inner circumferential surface 60A of the tank main body 6A. The reinforcing portion 6B is provided over the entire circumference with respect to the inner circumferential surface 60A of the tank main body 6A. The reinforcing portion 6B of the present embodiment has a plate shape. Therefore, the reinforcing portion 6B is provided in a rectangular annular shape so as not to block the center part of the tank main body 6A. In addition, in the reinforcing portion 6B, a plurality of rectangular holes 67 are formed at the connection part with the inner circumferential surface 60A of the tank main body 6A at the lower part of the vertical direction Dv. With the rectangular hole 67, when the lubricating oil in the tank main body 6A is completely removed by maintenance or the like, the lubricating oil stopped by the reinforcing portion 6B at the lower part of the vertical direction Dv can move in the tank main body 6A in the axial direction Da. As shown in FIG. 2, the plurality of reinforcing portions 6B are provided so as to be spaced apart in the axial direction Da.

The lubricating oil supply portion (lubricating oil supply device) 7 supplies the lubricating oil from the tank main body 6A through lubricating oil supply pipings 62A to 62E to the driving machine first bearing 22A, the driving machine second bearing 22B, the gear and the bearing on the inside of the transmission 4, the compressor first bearing 32A, and the compressor second bearing 32B, respectively. In addition, although the lubricating oil supply pipings 62A to 62E of the present embodiment are shown in FIG. 2 such that one piping branches, the lubricating oil supply pipings 62A to 62E are not limited to such a structure and may be respectively separated pipings. As shown in FIG. 2, the lubricating oil supply portion 7 of the present embodiment includes an oil pump 71, an oil cooler 72, and an oil filter 73 in the middle.

The oil pump 71 feeds the lubricating oil stored in the tank main body 6A toward the rotational driving machine 2, the transmission 4, and the compressor 3. The oil cooler 72 cools the lubricating oil sent from the oil pump 71. The oil filter 73 removes foreign matters, such as dust which is lost to the lubricating oil sent from the oil cooler 72.

As shown in FIG. 2, in the present embodiment, all of the equipment that configure the lubricating oil supply portion 7, such as the oil pump 71, the oil cooler 72, the oil filter 73, and the like, are provided on an upper portion 6*t* of the tank main body 6A.

In addition, the present invention is not limited to a case where all of the equipment that configure the lubricating oil supply portion 7, such as the oil pump 71, the oil cooler 72, the oil filter 73, and the like, are provided on the upper portion 6*t* of the tank main body 6A. For example, in a case where the oil cooler 72 is the shell and tube type, only a part of the equipment may be provided at a different location such that only the oil cooler 72 is provided at a part other than the upper portion 6*t* of the tank main body 6A.

As shown in FIG. 4, the fixing portion 8 attaches the tank main body 6A to the base plate 5. The fixing portion 8 has a first bracket 81, a second bracket 82, and a bolt 83. The fixing portion 8 attaches the tank main body 6A to the transverse web 52*c* of the transverse beam portion 52. The fixing portion 8 is provided at a plurality of locations with a space in the axial direction Da.

The first bracket 81 is joined to the transverse web 52*c* of the transverse beam portion 52 by welding or the like. The second bracket 82 is joined to a side surface 6*s* on the side opposing the transverse beam portion 52 in the tank main body 6A by welding or the like. The first bracket 81 and the second bracket 82 are connected to each other by the plurality of bolts 83.

The tank main body 6A attached to the transverse beam portion 52 via the first bracket 81 and the second bracket 82 is provided such that the upper portion 6*t* protrudes more upward than the transverse upper flange 52*a* of the transverse beam portion 52. Accordingly, the upper portion of the side surface 6*s* of the tank main body 6A of the present embodiment is exposed above the transverse upper flange 52*a*. As a result, the drain pipings 61A to 61E that extends straight are connected to the side surface 6*s* of the tank main body 6A.

In addition, the drain pipings 61A to 61E are not limited to the structure connected to the side surface 6*s* of the tank main body 6A. The drain pipings 61A to 61E may be connected to the upper portion 6*t* of the tank main body 6A.

In the above-described compressor module 1, the tank main body 6A for storing the lubricating oil is provided so as to protrude to the outer side in the width direction Dw from the base plate 5. In other words, the tank main body 6A is not installed in the base plate 5. As a result, it is possible to reduce the size of the base plate 5.

Specifically, in a case where the tank main body 6A is installed in the base plate 5, it is necessary to form the vertical beam portion 51 and the transverse beam portion 52 so as to ensure a space for allowing the tank main body 6A to enter. As a result, the base plate 5 becomes large in the axial direction Da or in the width direction Dw. However, by providing the tank main body 6A on the outer side in the width direction Dw from the base plate 5, the tank main body 6A can be disposed such that the positions of the rotational driving machine 2, the compressor 3, and the transmission 4 do not overlap each other in the vertical direction Dv. Therefore, it becomes unnecessary to install the tank main body 6A in the base plate 5 while using the base plate 5 and the tank main body 6A as separate members, and it is possible to save the space of the base plate 5. As a result, in the compressor module 1, while ensuring the merit that the installation work can be simplified by reducing the work, such as connection adjustment of the drain pipings 61A to 61E at the site, it is possible to reduce the size of the base plate 5.

Further, by making the tank main body 6A in a bottomed angular tubular shape that extends in the axial direction Da, it is possible to ensure the capacity of the tank main body 6A while limiting an overhanging dimension of the tank main body 6A to the outer side of the base plate 5 in the width direction Dw.

Accordingly, it is possible to save the space of the compressor module 1.

Therefore, it is possible to suppress the size, the weight, and the cost of the entire compressor module 1.

In addition, the tank main body 6A of which the length in the axial direction Da is substantially the same as the length of the base plate 5 in the axial direction Da is disposed on the outer side of the rotational driving machine 2, the compressor 3, and the transmission 4 in the width direction Dw. Therefore, only by extending the drain pipings 61A to 61E in the width direction Dw obliquely with respect to the vertical direction Dv, the rotational driving machine 2, the compressor 3, the transmission 4, and the tank main body 6A are connected to each other. In other words, the drain pipings 61A to 61E are connected to the tank main body 6A without extending in the axial direction Da. Therefore, the length of the drain pipings 61A to 61E can be suppressed to be short compared to a case where the drain pipings 61A to 61E extend in the axial direction Da and are connected to the tank main body 6A.

In addition, the drain pipings 61A to 61E connected to the side surface of the tank main body 6A are inclined downward in the vertical direction Dv as extending to the outer side in the width direction Dw. Therefore, while ensuring the gradient of the drain pipings 61A to 61E necessary for making the lubricating oil flow, it is possible to suppress the installation height of the driving machine first bearing 22A, the driving machine second bearing 22B, the gear and the bearing on the inside of the transmission 4, the compressor first bearing 32A, and the compressor second bearing 32B on the base plate 5. In other words, the height of the support portion 53 that supports the rotational driving machine 2, the compressor 3, and the transmission 4 is suppressed. Accordingly, the center height of the rotational driving machine 2, the compressor 3, and the transmission 4 (the height from the installation surface to the axial center of each device) is reduced, and the required rigidity of the base plate 5 is alleviated. As a result, it is possible to reduce the height or the number of the vertical beam portion 51 or the transverse beam portion 52, and to reduce the cost.

Furthermore, all of the equipment that configure the lubricating oil supply portion 7 are provided on the tank main body 6A. In this manner, it is possible to dispose most of the equipment that configure the lubricating oil supply portion 7 not on the base plate 5 but on the tank main body 6A. Therefore, it becomes unnecessary to ensure the space for installing the lubricating oil supply portion 7 on the base plate 5. Accordingly, it is possible to reduce the size of the base plate 5.

In addition, in a state where the reinforcing portion 6B is fixed to the inner circumferential surface 60A, the reinforcing portion 6B is provided in the tank main body 6A. Therefore, the tank main body 6A which is a hollow member that extends in the axial direction Da is reinforced from the inside by the reinforcing portion 6B. Therefore, when the tank main body 6A is made long in the axial direction Da, it is possible to ensure the rigidity in the axial direction Da without increasing the strength of the outer main body 6A itself by an expensive material, such as a high strength material.

Modification Example of Embodiment

Next, a modification example will be described. In the above-described embodiment, the tank main body 6A is fixed to the transverse web 52*c* of the transverse beam portion 52 via the first bracket 81 and the second bracket 82. However, the compressor module 1 is not limited to the structure in which the tank main body 6A is disposed so as to be spaced apart upward from above the foundation B in this manner.

Figure 5:
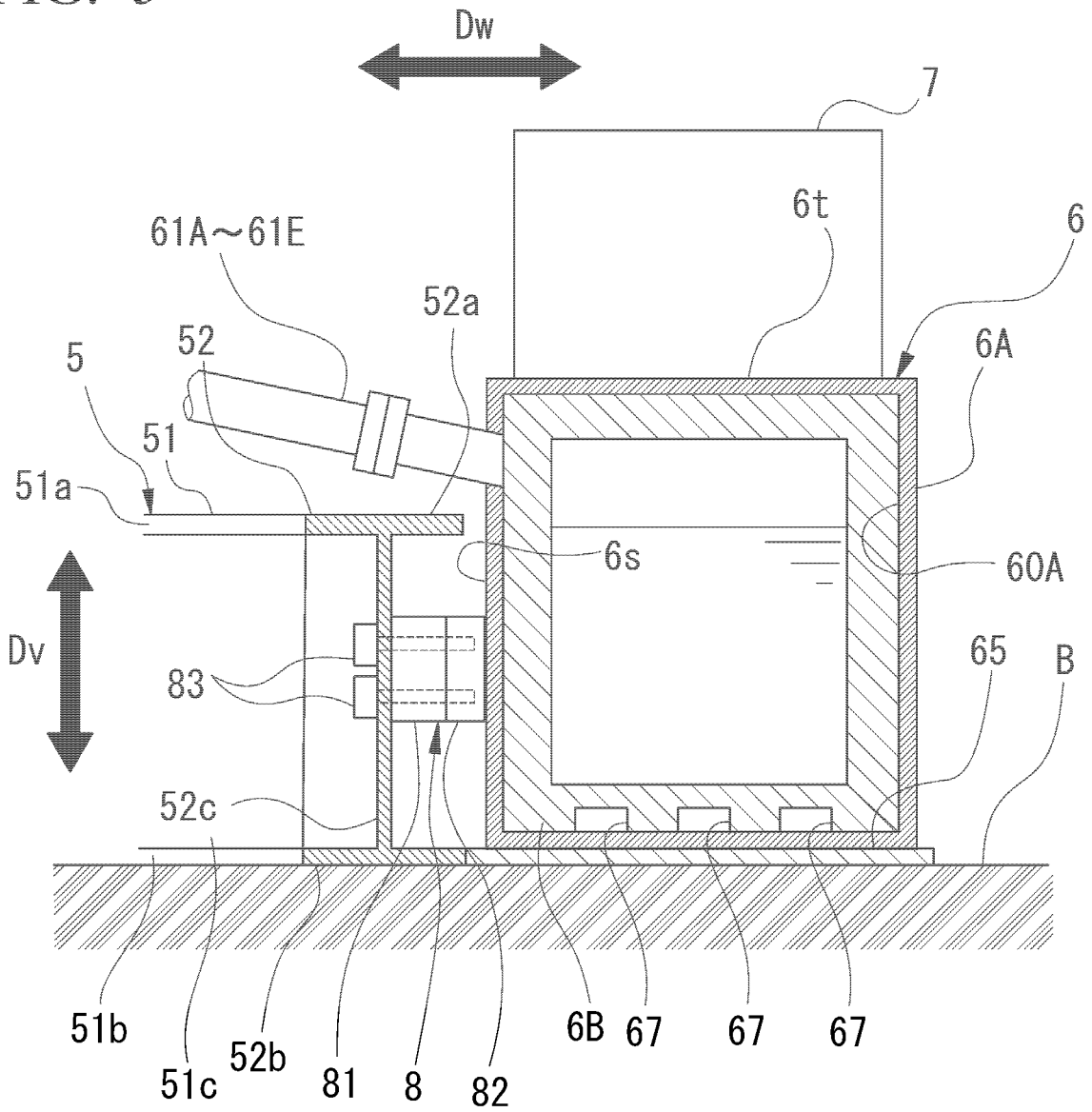
FIG. 5 is a sectional view showing a modification example of the compressor module according to the embodiment of the present invention from the axial direction.

For example, as shown in FIG. 5, the tank main body 6A may be installed so as to be placed on the foundation B on the outer side of the base plate 5 in the width direction Dw via a base member 65. In the modification example of the embodiment, similar to the above-described embodiment, the tank main body 6A is fixed to the transverse beam portion 52 by the fixing portion 8, but in the modification example, the tank main body 6A may be configured to be not fixed to the transverse beam portion 52 using the fixing portion 8.

According to the configuration, the tank main body 6A is installed so as to be placed on the foundation B. Therefore, regardless of the rigidity of the base plate 5 and the storage tank 6, it is possible to reliably hold the tank main body 6A disposed to protrude to the outer side of the base plate 5 in the width direction Dw.

Above, although the embodiment of the present invention has been described in detail with reference to the drawings, the respective configurations and combinations thereof in the embodiment and the modification example thereof are merely examples, and additions, omissions, substitutions, and other changes of configurations are possible within the scope not departing from the gist of the present invention. In addition, the present invention is not limited by the embodiments, but is limited only by the claims.

In addition, the rotational driving machine 2 is not limited to an electric motor as in the present embodiment, but may be any device as long as the device can drive the compressor 3. The rotational driving machine 2 may be, for example, a steam turbine or a gas turbine.

Further, the direction including the axial direction Da in which the tank main body 6A extends is not limited to the direction that matches the axial direction Da as in the present embodiment, but may be a direction including the component in the axial direction Da. Therefore, the direction including the axial direction Da may be, for example, a direction inclined with respect to the axial direction Da.

Further, the reinforcing portion 6B is not limited to the shape of the present embodiment as long as the tank main body 6A can be reinforced. Therefore, the reinforcing portion 6B may have a structure that reinforces the tank main body 6A from the outside, for example.

Further, in the fixing portion 8 of the present embodiment, the base plate 5 and the storage tank 6 are connected to each other by connecting the first bracket 81 and the second bracket 82 with the bolts 83. However, the fixing portion 8 is not limited to such a structure as long as it is possible to connect the base plate 5 and the storage tank 6 to each other. Therefore, the fixing portion 8 may be, for example, a structure that supports the upper portion 6*t* of the tank main body 6A.

INDUSTRIAL APPLICABILITY

According to the above-described compressor module 1, it is possible to reduce the size of the base plate 5 and to save the space.

REFERENCE SIGNS LIST

1 COMPRESSOR MODULE
2 ROTATIONAL DRIVING MACHINE
21 OUTPUT SHAFT

22A DRIVING MACHINE FIRST BEARING
22B DRIVING MACHINE SECOND BEARING
3 COMPRESSOR
31 ROTOR
32A COMPRESSOR FIRST BEARING
32B COMPRESSOR SECOND BEARING
4 TRANSMISSION
41 TRANSMISSION INPUT SHAFT
42 TRANSMISSION OUTPUT SHAFT
5 BASE PLATE
51 VERTICAL BEAM PORTION (FIRST BEAM PORTION)
51*a* VERTICAL UPPER FLANGE
51*b* VERTICAL LOWER FLANGE
51*c* VERTICAL WEB
52 TRANSVERSE BEAM PORTION (SECOND BEAM PORTION)
52*a* TRANSVERSE UPPER FLANGE
52*b* TRANSVERSE LOWER FLANGE
52*c* TRANSVERSE WEB (SIDE SURFACE)
6 STORAGE TANK
6A TANK MAIN BODY
6B REINFORCING PORTION
60A INNER CIRCUMFERENTIAL SURFACE
6*s* SIDE SURFACE
6*t* UPPER PORTION
7 LUBRICATING OIL SUPPLY PORTION (LUBRICATING OIL SUPPLY DEVICE)
71 OIL PUMP
72 OIL COOLER
73 OIL FILTER
8 FIXING PORTION
81 FIRST BRACKET
82 SECOND BRACKET
83 BOLT
61A TO 61E DRAIN PIPING
62A TO 62E LUBRICATING OIL SUPPLY PIPING
65 BASE MEMBER
67 RECTANGULAR HOLE
C1 FIRST AXIS (AXIS)
C2 SECOND AXIS (AXIS)
Da AXIAL DIRECTION
Dv VERTICAL DIRECTION
Dw WIDTH DIRECTION

What is claimed is:

1. A compressor module comprising:

a rotational driving machine having an output shaft that is rotationally driven around a first axis;

a compressor disposed along an axial direction, which is parallel to a direction in which the first axis extends, with respect to the rotational driving machine and wherein rotation of the output shaft is transmitted to the compressor;

a base plate that supports the rotational driving machine and the compressor from below in a vertical direction and that is larger than the rotational driving machine and the compressor when viewed from above in the vertical direction; and a storage tank configured to store lubricating oil used in the rotational driving machine and the compressor, wherein the storage tank comprises a tubular tank main body that is provided on an outer side of the base plate in a width direction intersecting with the axial direction and extends in a direction parallel to the axial direction, wherein the rotational driving machine comprises a first drive machine bearing and a second drive machine bearing that rotatably support the output shaft, wherein the compressor comprises:

a rotor that rotates by transmitting a rotation of the output shaft; and a first compressor bearing and a second compressor bearing that rotatably support the rotor around a second axis, wherein the tank main body extends parallel to the axial direction and overlaps the first drive machine bearing, the second drive machine bearing, the first compressor bearing, and the second compressor bearing when viewed in a direction orthogonal to the axial direction, wherein the compressor module further comprises drain pipings that:

return the lubricating oil to the storage tank from the first drive machine bearing, the second drive machine bearing, the first compressor bearing, and the second compressor bearing, extend straight to the tank main body from the first drive machine bearing, the second drive machine bearing, the first compressor bearing, and the second compressor bearing, and are connected to the first drive machine bearing, the second drive machine bearing, the first compressor bearing, and the second compressor bearing, wherein the storage tank comprises a reinforcing portion that is disposed inside the tank main body and that reinforces the tank main body, wherein the drain pipings are inclined so as to extend downward in the vertical direction and extend in the width direction toward the tank main body, wherein an upper portion of the tank main body protrudes upward from the base plate such that an upper portion of a side surface of the tank main body is exposed above the base plate, and wherein the drain pipings are connected to the upper portion of the side surface of the tank main body.

2. The compressor module according to claim 1, wherein the base plate includes a first beam portion which is provided with a space in the axial direction and extends in the width direction, and a second beam portion which is provided with a space in the width direction and extends in the axial direction, and wherein the tank main body is fixed to a side surface of the second beam portion, when viewed from above in the vertical direction.

3. The compressor module according to claim 1, wherein a lubricating oil supply device that is configured to supply the lubricating oil to the rotational driving machine and the compressor is provided on the tank main body.

* * * * *